US011289039B2

(12) United States Patent
Du et al.

(10) Patent No.: US 11,289,039 B2
(45) Date of Patent: Mar. 29, 2022

(54) GATE-DRIVING UNIT CIRCUIT HAVING PRE-PULL DOWN SUB-CIRCUIT, GATE DRIVER ON ARRAY CIRCUIT, DRIVING METHOD, AND DISPLAY APPARATUS THEREOF

(71) Applicants: Hefei Xinsheng Optoelectronics Technology Co., Ltd., Anhui (CN); BOE Technology Group Co., Ltd., Beijing (CN)

(72) Inventors: Ruifang Du, Beijing (CN); Zijun Cao, Beijing (CN); Xiaoye Ma, Beijing (CN)

(73) Assignees: Hefei Xinsheng Optoelectronics Technology Co., Ltd., Anhui (CN); BOE Technology Group Co., Ltd., Beijing (CN)

( * ) Notice: Subject to any disclaimer, the term of this patent is extended or adjusted under 35 U.S.C. 154(b) by 613 days.

(21) Appl. No.: 16/314,757

(22) PCT Filed: Jun. 7, 2018

(86) PCT No.: PCT/CN2018/090259

§ 371 (c)(1),
(2) Date: Jan. 2, 2019

(87) PCT Pub. No.: WO2019/095679

PCT Pub. Date: May 23, 2019

(65) Prior Publication Data

US 2021/0327377 A1 Oct. 21, 2021

(30) Foreign Application Priority Data

Nov. 17, 2017 (CN) ..... 201711145565.9

(51) Int. Cl.
*G09G 3/36* (2006.01)

(52) U.S. Cl.
CPC ..... *G09G 3/3611* (2013.01); *G09G 2310/08* (2013.01)

(58) Field of Classification Search
CPC ..... G09G 3/3611; G09G 2310/08
See application file for complete search history.

(56) References Cited

U.S. PATENT DOCUMENTS

2018/0336847 A1 11/2018 Chen et al.
2019/0066562 A1* 2/2019 Hu ..... G11C 19/28
2020/0013361 A1* 1/2020 Lv ..... G11C 19/28

FOREIGN PATENT DOCUMENTS

CN 107170404 A 9/2017
CN 107274856 A 10/2017
WO 2015158015 A1 10/2015

OTHER PUBLICATIONS

The Extended European Search Report in the European Patent Application No. 18847180.9, dated May 14, 2021.

* cited by examiner

*Primary Examiner* — Kwang-Su Yang
(74) *Attorney, Agent, or Firm* — Intellectual Valley Law, P.C.

(57) ABSTRACT

The present application discloses a gate-driving unit circuit. The gate-driving unit circuit includes an input sub-circuit coupled to an input terminal and a pull-up node, and configured to charge a pull-up node to a turn-on voltage level. Additionally, the gate-driving unit circuit includes a pre-pull-down sub-circuit coupled to a pull-down node, a pre-pull-down node, and a reference voltage terminal, and configured to pull down voltage levels at the pull-down node and the pre-pull-down node to a turn-off voltage level before the pull-up node is charged to the turn-on voltage level. Therefore, potential charging delay in the pull-down node caused by a transistor threshold voltage shift is avoided. The (Continued)

gate-driving unit circuit further includes a pull-down sub-circuit, a pull-down control sub-circuit, a noise-reduction sub-circuit, a reset sub-circuit, and an output sub-circuit to couple with the input sub-circuit and the pre-pull-down sub-circuit to output a gate-driving signal.

19 Claims, 5 Drawing Sheets

GATE-DRIVING UNIT CIRCUIT HAVING PRE-PULL DOWN SUB-CIRCUIT, GATE DRIVER ON ARRAY CIRCUIT, DRIVING METHOD, AND DISPLAY APPARATUS THEREOF

CROSS-REFERENCE TO RELATED APPLICATION

This application is a national stage application under 35 U.S.C. § 371 of International Application No. PCT/CN2018/090259 filed Jun. 7, 2018, which claims priority to Chinese Patent Application No. 201711145565.9, filed on Nov. 17, 2017, the contents of which are incorporated by reference in the entirety.

TECHNICAL FIELD

The present invention relates to display technology, more particularly, to a gate-driving unit circuit, a gate driver on array circuit, a driving method, and a display apparatus thereof.

BACKGROUND

Gate driver on array technology is to integrate thin film transistors (TFTs) directly on a substrate (for a display panel) to form a gate-driver-on-array (GOA) circuit to drive the display panel for progressively displaying frames of images. Because of advantages of the GOA technology in low cost, enhanced production, and benefit of realization of narrow boarder for making the display panel, it is widely applied in the display industry. While, it is desired to continue improving circuit design for enhancing reliability as well as functionality.

SUMMARY

In an aspect, the present disclosure provides a gate-driving unit circuit. The gate-driving unit circuit includes an input sub-circuit coupled to an input terminal and a pull-up node, and configured to charge a pull-up node to a turn-on voltage level. The gate-driving unit circuit further includes a pre-pull-down sub-circuit coupled to a pull-down node, a pre-pull-down node, and a reference voltage terminal, and configured to pull down voltage levels at the pull-down node and the pre-pull-down node to a turn-off voltage level before the pull-up node is charged to the turn-on voltage level. Additionally, the gate-driving unit circuit includes a pull-down sub-circuit coupled to the input sub-circuit via the pull-up node, coupled to the pre-pull-down sub-circuit via the pre-pull-down node, coupled to the pull-down node and the reference voltage terminal, and configured to pull down a voltage level at the pull-down node to a turn-off voltage level. The gate-driving unit circuit further includes a pull-down control sub-circuit coupled to the pre-pull-down sub-circuit and the pull-down sub-circuit via the pre-pull-down node, and configured to pull down a voltage level at the pre-pull-down node and the pull-down node to the turn-off voltage level. Furthermore, the gate-driving unit circuit includes a noise-reduction sub-circuit coupled to the pull-down control sub-circuit and the pull-down sub-circuit via the pull-down node, coupled to the pull-up node, an output terminal, and the reference voltage terminal, and configured to stabilize voltage levels of the pull-up node and the output terminal. Moreover, the gate-driving unit circuit includes an output sub-circuit coupled to the pull-up node, a clock signal terminal, the output terminal, and configured to output a gate-driving signal to the output terminal.

Optionally, the input sub-circuit includes a first transistor having a gate electrode and a first electrode coupled to the input terminal and a second electrode coupled to the pull-up node.

Optionally, the pull-down control sub-circuit includes a fifth transistor and a sixth transistor. The fifth transistor has a gate electrode and a first electrode coupled to a power-supply voltage terminal, and a second electrode coupled to the pre-pull-down node. The sixth transistor has a gate electrode coupled to the pre-pull-down node, a first electrode coupled to the first electrode of the fifth transistor, and a second electrode coupled to the pull-down node.

Optionally, the pre-pull-down sub-circuit includes an eleventh transistor and a twelfth transistor. The eleventh transistor has a gate electrode coupled to a pre-pull-down signal terminal, a first electrode coupled to the reference voltage terminal, and a second electrode coupled to the pre-pull-down node. The twelfth transistor has a gate electrode coupled to the pre-pull-down signal terminal, a first electrode coupled to the reference voltage terminal, and a second electrode coupled to the pull-down node.

Optionally, the gate-driving unit circuit further includes a reset sub-circuit coupled to the pull-up node, the output terminal, a reset signal terminal, and the reference voltage terminal, and configured to reset voltage levels of the pull-up node and the output terminal. The reset sub-circuit includes a second transistor and a fourth transistor. The second transistor has a gate electrode coupled to a reset signal terminal, a first electrode coupled to the reference voltage terminal, and a second electrode coupled to the pull-up node. The fourth transistor has a gate electrode coupled to the reset signal terminal, a first electrode coupled to the reference voltage terminal, and a second electrode coupled to the output terminal.

Optionally, the noise-reduction sub-circuit includes a ninth transistor and a tenth transistor. The ninth transistor has a gate electrode coupled to the pull-down node, a first electrode coupled to the reference voltage terminal, and a second electrode coupled to the pull-up node. The tenth transistor has a gate electrode coupled to the pull-down node, a first electrode coupled to the reference voltage terminal, and a second electrode coupled to the output terminal.

Optionally, the output sub-circuit includes a third transistor and a storage capacitor. The third transistor has a gate electrode coupled to the pull-up node, a first electrode coupled to a clock signal terminal, and a second electrode coupled to the output terminal. The storage capacitor has a first port coupled to the pull-up node and a second port coupled to the output terminal.

Optionally, the turn-on voltage level includes a voltage level applicable to a gate electrode of a transistor that allows a first electrode of the transistor to be connected with a second electrode of the transistor. The turn-off voltage level includes a voltage level applicable to a gate electrode of a transistor that allows a first electrode of the transistor to be disconnected from a second electrode of the transistor.

In another aspect, the present disclosure provides a gate-driving unit circuit. The gate-driving unit circuit includes a first transistor having a gate electrode and a first electrode commonly coupled to an input terminal and a second electrode coupled to a pull-up node; a second transistor having a gate electrode coupled to a reset signal terminal, a first electrode coupled to a reference voltage terminal, and a second electrode coupled to the pull-up node; a third transistor having a gate electrode coupled to the pull-up node, a first electrode coupled to a clock signal terminal, and a second electrode coupled to an output terminal; a fourth transistor having a gate electrode coupled to the reset signal terminal, a first electrode coupled to the reference voltage terminal, and a second electrode coupled to the output terminal; a fifth transistor having a gate electrode and a first electrode coupled to a power-supply voltage terminal, and a second electrode coupled to a pre-pull-down node; a sixth transistor having a gate electrode coupled to the pre-pull-down node, a first electrode coupled to the first electrode of the fifth transistor, and a second electrode coupled to a pull-down node; a seventh transistor having a gate electrode coupled to the pull-up node, a first electrode coupled to the reference voltage terminal, and a second electrode coupled to the pre-pull-down node; an eighth transistor having a gate electrode coupled to the pull-up node, a first electrode coupled to the reference voltage terminal, and a second electrode coupled to the pull-down node; a ninth transistor having a gate electrode coupled to the pull-down node, a first electrode coupled to the reference voltage terminal, and a second electrode coupled to the pull-up node; a tenth transistor having a gate electrode coupled to the pull-down node, a first electrode coupled to the reference voltage terminal, and a second electrode coupled to the output terminal; an eleventh transistor having a gate electrode coupled to the pre-pull-down signal terminal, a first electrode coupled to the reference voltage terminal, and a second electrode coupled to the pre-pull-down node; a twelfth transistor having a gate electrode coupled to the pre-pull-down signal terminal, a first electrode coupled to the reference voltage terminal, and a second electrode coupled to the pull-down node; and a storage capacitor having a first port coupled to the pull-up node and a second port coupled to the output terminal.

In another aspect, the present disclosure provides a gate driver on array (GOA) circuit including a plurality of gate-driving unit circuits cascaded in a multi-stage series. Each of the plurality of gate-driving unit circuits is configured according to the gate-driving unit circuit described herein. The multi-stage series includes at least a gate-driving unit circuit in an (N−2)-th stage coupled to a gate-driving unit circuit in an (N−1)-th stage which further is coupled to a gate-driving unit circuit in an N-th stage, wherein N is an integer greater than 2.

Optionally, the gate-driving unit circuit in the (N−2)-th stage includes an output terminal connected to the input terminal of the gate-driving unit circuit in an N-th stage. The gate-driving unit circuit in the (N−1)-th stage includes an input terminal connected to a pre-pull-down signal terminal of the gate-driving unit circuit in the N-th stage. The gate-driving unit circuit in an (N+2)-th stage includes an output terminal connected to the reset signal terminal of the gate-driving unit circuit in the N-th stage.

In yet another aspect, the present disclosure provides a method of driving a GOA circuit described herein. The method includes driving a gate-driving unit circuit in an N-th stage in an N-th cycle of displaying one frame of image progressively from one stage after another. The N-th cycle includes a duration commonly for every cycle including sequentially a first period, a second period, a third period, a fourth period, a fifth period, and a sixth period.

Optionally, the step of driving a gate-driving unit circuit in the N-th stage includes, in the first period of the N-th cycle, keeping a pull-up node and an output terminal of the gate-driving unit circuit in an N-th stage to a turn-off voltage level under control of a voltage level at a pull-down node in the gate-driving unit circuit in an N-th stage. The same step further includes, in the second period of the N-th cycle, pulling down a voltage level at a pre-pull-down node and a voltage level at the pull-down node of the gate-driving unit circuit in the N-th stage to a turn-off voltage level under control of an input signal of the gate-driving unit circuit in the (N−1)-th stage before charging the pull-up node. Additionally, the same step includes, in the third period of the N-th cycle, keeping the voltage level of the pre-pull-down node and the voltage level of the pull-down node to the turn-off voltage level under control of the turn-on voltage level charged to the pull-up node. The same step further includes, in the fourth period of the N-th cycle, receiving an output signal from the gate-driving unit circuit in the (N−2)-th stage into an input terminal of the gate-driving unit circuit in the N-th stage and storing the output signal at an pull-up node of the gate-driving unit circuit in the N-th stage for charging the pull-up node. Furthermore, the same step includes, in the fifth period of the N-th cycle, outputting a gate-driving signal to a gate line of the N-th stage under control of a clock signal. Moreover, the same step includes, in the sixth period of the N-th cycle, receiving an output signal from the gate-driving unit circuit in an (N+2)-th stage into a reset terminal of the gate-driving unit circuit in the N-th stage, and pulling down the voltage level at the pull-up node and the voltage level at the output terminal of the gate-driving unit circuit in the N-th stage.

Optionally, the step of pulling down the voltage level at the pre-pull-down node and the voltage level at the pull-down node of the gate-driving unit circuit in the N-th stage to the turn-off voltage level is performed at least during an (N−1)-th cycle or earlier before the N-th cycle.

Optionally, the step of pulling down the voltage level at the pre-pull-down node and the voltage level at the pull-down node includes receiving an input signal of the turn-on voltage level by an input terminal of the gate-driving unit circuit in the (N−1)-th stage and passing the turn-on voltage level to a pre-pull-down signal terminal of the gate-driving unit circuit in the N-th stage to allow the pre-pull-down node and the pull-down node connected with a reference voltage terminal fixed at the turn-off voltage level.

Optionally, the step of keeping a pull-up node and an output terminal of the gate-driving unit circuit in an N-th stage to a turn-off voltage level includes applying a power-supply voltage at a turn-on voltage level at least in the first period to respectively make the pre-pull-down node and the pull-down node at the turn-on voltage level to allow the pull-up node and the output terminal connected the reference voltage terminal fixed at the turn-off voltage level.

In still another aspect, the present disclosure provides a display apparatus including a gate driver on array (GOA) circuit described herein.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

Figure 1:
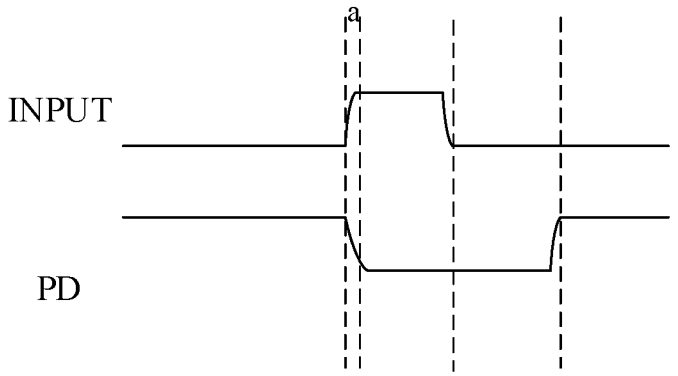
FIG. 1 Prior Art
FIG. 1 is a timing diagram of driving a conventional gate-driving unit circuit with an input signal and a pull-down node voltage under a signal delay.

An important aspect of the GOA circuit design is to realize signal shift registration and circuit reliability. In many existing circuit designs of the GOA circuit, because of thin film transistor threshold voltage shift due to temperature or operation time, some voltage signals associated with operation of the GOA circuit suffer certain un-wanted delays. FIG. 1 is a timing diagram of driving a conventional gate-driving unit circuit with an input signal and a pull-down node voltage under a signal delay. Referring to FIG. 1, the delay in pull-down node voltage causes different thin film transistors in different functional sub-circuits to falsely be turned on at a same time in several periods of an operation cycle, affecting GOA circuit reliability in its operation.

Accordingly, the present disclosure provides, inter alia, a gate-driving unit circuit, a gate driver on array circuit, a driving method, and a display apparatus thereof that substantially obviate one or more of the problems due to limitations and disadvantages of the related art. In one aspect, the present disclosure provides a gate-driving unit circuit with at least a pre-pull-down sub-circuit. The gate-driving unit circuit is used as one of multiple unit circuits in a gate driver on array (GOA) circuit with at least an added function of pulling down voltage levels at a pull-down node and a pre-pull-down node therein so that the effect of transistor threshold voltage shift on the GOA circuit is reduced, enhancing circuit reliability.

Figure 2:
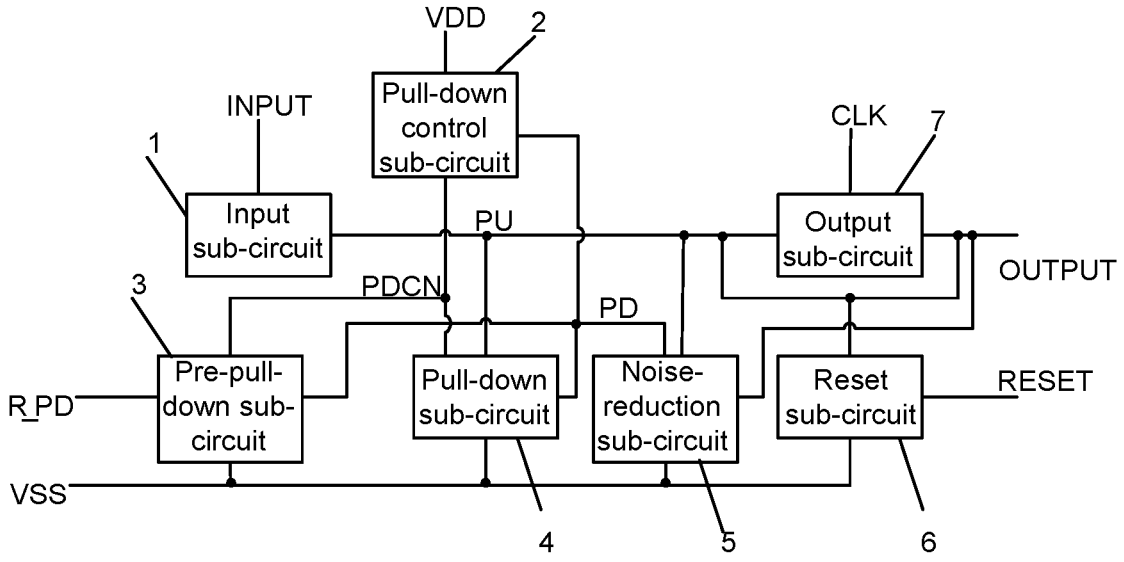
FIG. 2 is a block diagram of a gate-driving unit circuit according to some embodiments of the present disclosure.

FIG. 2 is a block diagram of a gate-driving unit circuit according to some embodiments of the present disclosure. Referring to FIG. 2, the gate-driving unit circuit includes an input sub-circuit 1, a pull-down control sub-circuit 2, a pre-pull-down sub-circuit 3, a pull-down sub-circuit 4, a noise-reduction sub-circuit 5, a reset sub-circuit, and an output sub-circuit 7. In an embodiment, the input sub-circuit 1 respectively couples to the pull-down sub-circuit 4, the output sub-circuit 7, and an input terminal INPUT. The input sub-circuit 1 is configured to charge a pull-up node PU to pull up a voltage level of PU to a turn-on voltage level. The pull-up node PU is a joint node of the input sub-circuit 1 and the pull-down sub-circuit 4 and the output sub-circuit 7. Optionally, the turn-on voltage level is a high voltage level for turning an n-type transistor on.

In the embodiment, the pull-down control sub-circuit 2 respectively couples to the pre-pull-down sub-circuit 3, the pull-down sub-circuit 4, and a power-supply terminal VDD. The pull-down control sub-circuit 2 is configured to pull down voltage levels of a pre-pull-down node PDCN and a pull-down node PD to a turn-off voltage level. Optionally, the power-supply terminal VDD provides a fixed positive voltage. Optionally, the power-supply terminal VDD provides a power-supply voltage alternatively cycled in high or low voltage levels. The pre-pull-down node PDCN is a joint node of the pull-down control sub-circuit 2, the pre-pull-down sub-circuit 3, and the pull-down sub-circuit 4. The pull-down node PD is a joint node of the pull-down control sub-circuit 2, the pull-down sub-circuit 4, and the noise-reduction sub-circuit 5. Optionally, the turn-off voltage level is a low voltage level for turning an n-type transistor off.

In the embodiment, the pre-pull-down sub-circuit 3 respectively couples to the pull-down node PD and a reference voltage terminal VSS. The pre-pull-down sub-circuit 3 is configured to pull down voltage levels of the pull-down node PD and the pre-pull-down node PDCN to the turn-off voltage level before charging the pull-up node PU under control of a voltage level at the pre-pull-down node PDCN.

Referring to FIG. 2, the pull-down sub-circuit 4 also couples to the reference voltage terminal VSS. Optionally, VSS is set to a low voltage level including 0V. The pull-down sub-circuit 4 is configured to pull down the voltage level of the pull-down node PD to the turn-off voltage level or a low voltage level under control of a voltage level at the pull-up node PU.

Referring to FIG. 2 again, the noise-reduction sub-circuit 5 couples to the pull-up node PU, an output terminal OUTPUT, and the reference voltage terminal VSS. The noise-reduction sub-circuit 5 is configured to keep voltage levels of the pull-up node PU and the output terminal OUTPUT at a low voltage level (at least in one period of an operation cycle) to reduce noise level of an output signal.

Further, the reset sub-circuit 6 respectively couples to the pull-up node PU, the output terminal OUTPUT, the reset sub-circuit 6 is configured to reset the voltage levels of the pull-up node PU and the output terminal OUTPUT under control of a reset signal from the reset terminal.

Furthermore, the output sub-circuit 7 couples to a clock signal terminal CLK and is configured to output a gate-driving signal at the output terminal of a current stage (i.e., a stage of the gate-driving unit circuit in a multi-stage series of the GOA circuit) under control of the clock signal CLK and the voltage level of the pull-up node PU. Optionally, the current stage is labeled as an N-th stage, here N is an integer varied from 1 to an arbitrary integer greater than 2.

Figure 3:
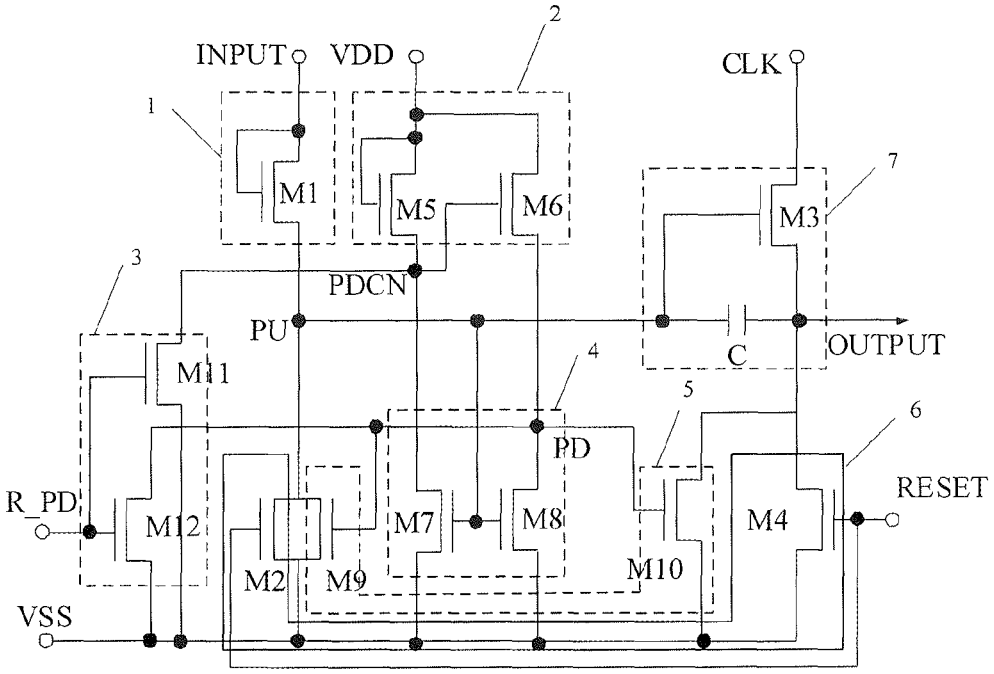
FIG. 3 is circuitry diagram of a gate-driving unit circuit according to an embodiment of the present disclosure.

The gate-driving unit circuit of the present disclosure is able to avoid transistors in the noise-reduction sub-circuit to be turned on at the same time with transistors in other sub-circuits. FIG. 3 shows a specific embodiment of the circuit structure and circuitry connections under the scope of the gate-driving unit circuit of FIG. 2. Referring to FIG. 3, the input sub-circuit 1 receives an input signal from the input terminal INPUT. The input sub-circuit 1 includes a first transistor M1 having a control electrode or gate electrode and a first electrode commonly coupled to the input terminal INPUT and a second electrode coupled to a pull-up node PU.

The pull-down control sub-circuit 2 includes a fifth transistor M5 and a sixth transistor M6. M5 has a control electrode or gate electrode and a first electrode commonly coupled to a power-supply terminal VDD. M5 has a second electrode coupled to the pre-pull-down node PDCN. M6 has a control electrode or gate electrode coupled to the pre-pull-down node PDCN, a first electrode coupled to the first electrode of M5 (also coupled to VDD), and a second electrode coupled to a pull-down node PD.

The pre-pull-down sub-circuit 3 is configured to pull down voltage levels of PD and PDCN nodes ahead of time when the pull-up node is charged so that the transistors in the noise-reduction sub-circuit can be turned off. Referring to FIG. 3, the pre-pull-down sub-circuit 3 includes an eleventh transistor M11 and a twelfth transistor M12. M11 has a control electrode or gate electrode coupled to the pre-pull-down signal terminal R_PD, a first electrode coupled to a reference voltage terminal VSS, and a second electrode coupled to the pre-pull-down node PDCN. M12 has a control electrode coupled to the terminal R_PD, a first electrode coupled to the reference voltage terminal VSS, and a second electrode coupled to the pull-down node PD.

The pull-down sub-circuit 4 is configured to pull down voltage levels of the PD node and PDCN node. The pull-down sub-circuit 4 includes a seventh transistor M7 and an eighth transistor M8. M7 has a control electrode coupled to the pull-up node PU, a first electrode coupled to VSS, and a second electrode coupled to the pre-pull-down node PDCN. M8 has a control electrode coupled to the pull-up node PU, a first electrode coupled to VSS, and the second electrode coupled to the pull-down node PD.

The reset sub-circuit 6 is to reset voltage levels of the pull-up node PU and an output terminal OUTPUT. Referring to FIG. 3, the reset sub-circuit 6 includes a second transistor M2 and a fourth transistor M4. M2 has a control electrode coupled to a reset terminal RESET, a first electrode coupled to the reference voltage terminal VSS, and a second electrode coupled to the pull-up node PU. M4 has a control electrode coupled to RESET, a first electrode coupled to VSS, and a second electrode coupled to the output terminal OUTPUT.

The noise-reduction sub-circuit 5 reduces noises in output terminal to enhance signal-to-noise ratio of an output signal of the gate-driving unit circuit. The noise-reduction sub-circuit 5 includes a ninth transistor M9 and a tenth transistor M10. M9 has a control electrode coupled to the pull-down node PD, a first electrode coupled to VSS, and a second electrode coupled to the pull-up node PU. M10 has a control electrode coupled to the pull-down node PD, a first electrode coupled to VSS, and a second electrode coupled to the output terminal OUTPUT.

The output sub-circuit 7 includes a third transistor M3 and a storage capacitor C. The third transistor M3 has a control electrode coupled to a first terminal of the storage capacitor C and coupled to the pull-up node PU. M3 also has a first electrode coupled to a clock signal terminal CLK. M3 also has a second electrode coupled to a second terminal of the storage capacitor C and the output terminal OUTPUT.

All transistors in the gate-driving unit circuit are either n-type transistors or p-type transistors. The first electrode or the second electrode of each transistor can be either a drain electrode or a source electrode thereof. Alternatively, the transistors in the gate-driving unit circuit can be mixed with n-type transistors or p-type transistors with proper adjustment in control signal selections.

In another aspect, the present disclosure provides a gate driver on array (GOA) circuit by cascading multiple gate-driving unit circuits in a multi-stage series associated with a display panel. The GOA circuit is configured to provide a gate-driving signal from any one gate-driving unit circuit of an N-th stage to a corresponding gate line of the N-th stage in an N-th cycle progressively scanning from a first gate line N=1 in a first cycle to a last gate line N=M in a last cycle to display a full frame of image on the display panel.

From a current N-th stage perspective in the cascaded GOA circuit, an output terminal of a gate-driving unit circuit in two-stage before the current stage, i.e., the (N−2)-th stage, is connected to an input terminal of the input sub-circuit 1 of the gate-driving unit circuit in the current N-th stage. An input terminal of the gate-driving unit circuit in one-stage before the current stage, i.e., the (N−1)-th stage, is connected to a pre-pull-down signal terminal of the pre-pull-down sub-circuit 3 of the gate-driving unit circuit in the current N-th stage. An output terminal of the gate-driving unit circuit in two-stage after the current stage, i.e. the (N+2)-th stage, is connected to a reset signal terminal of the reset sub-circuit 6 of the gate-driving unit circuit in the current N-th stage. Here N is an integer at least greater than 2.

Figure 4:
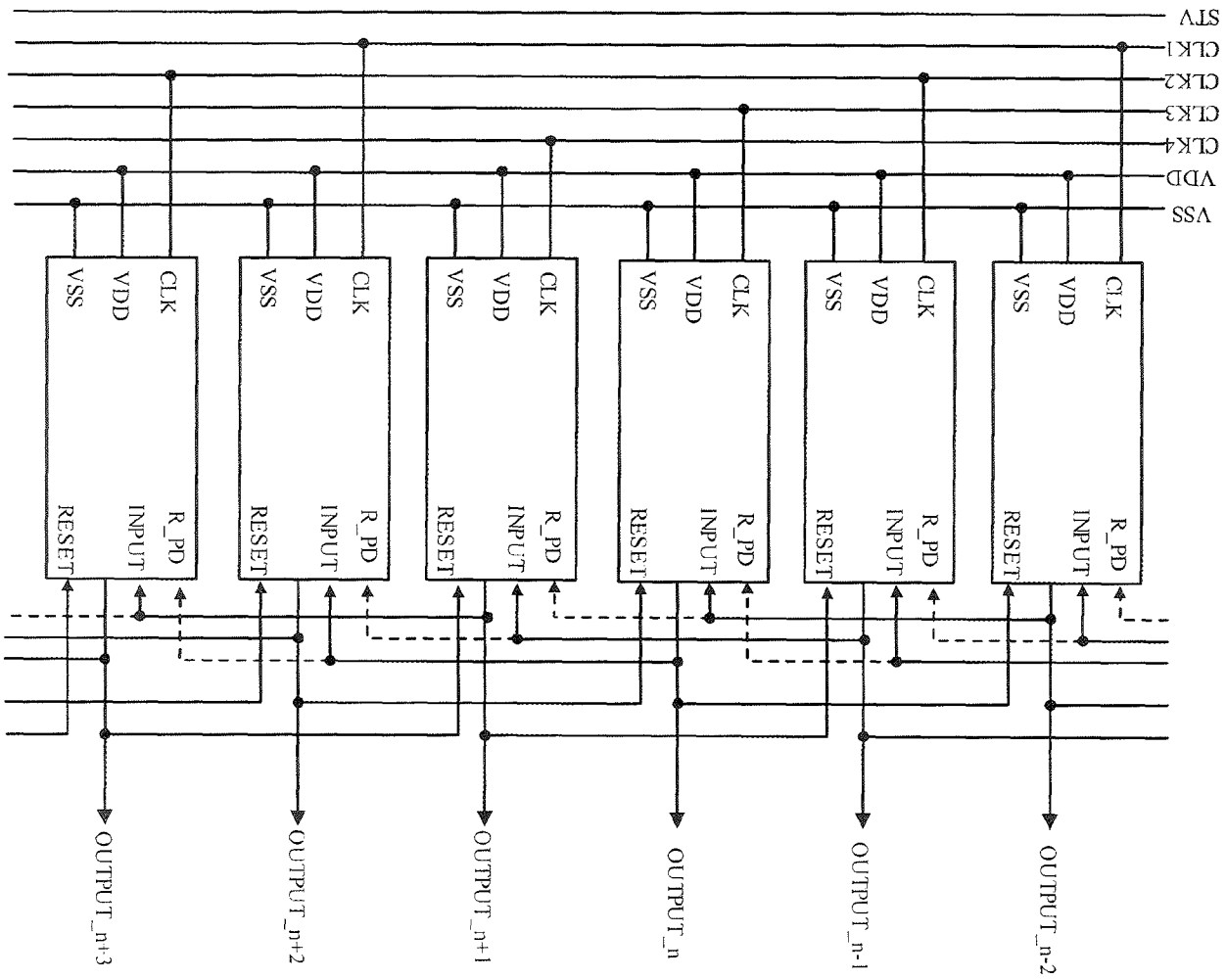
FIG. 4 is a cascading structure diagram of a gate driver on array circuit according to some embodiments of the present disclosure.

FIG. 4 shows an example of a GOA circuit based on four clock signals. Referring to FIG. 4, OUTPUT of the (n−2)-th unit circuit is connected to INPUT of the n-th unit circuit. OUTPUT of the (n+2)-th unit circuit is connected to RESET of the n-th unit circuit. OUTPUT of the (n−3)-th unit circuit, which is also connected to INPUT of the (n−1)-th unit circuit, is provided to R_PD of the n-th unit circuit.

In this GOA circuit and referring to the circuitry structure of each gate-driving unit circuit of FIG. 3, through transistor M11 and transistor M12, the output terminal OUTPUT of the (n−3)-th unit circuit is connected to the pre-pull-down signal terminal R_PD of the n-th unit circuit. Before an input signal is provided to charge the pull-up node PU of the current stage gate-driving unit circuit, the pull-down node PD and the pre-pull-down node PDCN of the current stage gate-driving unit circuit has been pulled to a low voltage (or a turn-off voltage level) to turn transistor M9 and transistor M10 off. This prevents that transistor M1 and transistor M9 are turned on at a same time during operation of the gate-driving unit circuit of the current stage, enhancing reliability of the GOA circuit.

Figure 5:
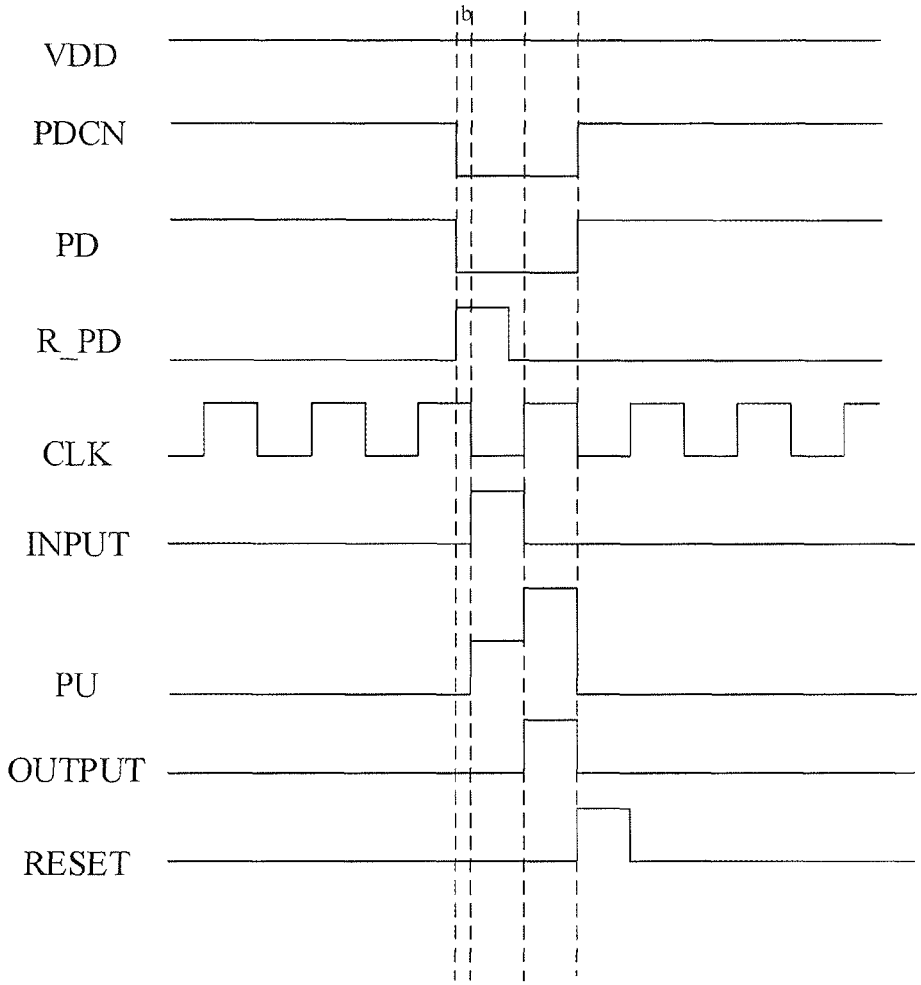
FIG. 5 is a timing diagram of driving the gate driver on array circuit according to an embodiment of the present disclosure.

In yet another aspect, the present disclosure provides a method of driving the GOA circuit having multi-stage cascaded gate-driving unit circuits. FIG. 5 is a timing diagram of driving the gate driver on array circuit according to an embodiment of the present disclosure. Referring to FIG. 5, the method of driving a GOA circuit associated with a display panel includes driving a gate-driving unit circuit in an N-th stage in an N-th cycle of displaying one frame of image progressively one stage after another. The N-th cycle is a current cycle repeatedly for every cycle including sequentially a first period, a second period, a third period, a fourth period, a fifth period, and a sixth period. Here N can be an integer varied from 1 to any integer greater than 2.

In the fourth period, i.e., an input period, the method includes having an input sub-circuit 1 of a current N-th stage to receive an output signal (i.e., a gate-driving signal) from an output sub-circuit 7 of the (N−2)-th stage. Further, the method includes storing the output signal to a pull-up node PU for charging a voltage level of PU to a turn-on voltage level.

In the fifth period, i.e., an output period, the method includes outputting an high voltage level (i.e., transistor turn-on voltage level) via an output terminal OUTPUT of an output sub-circuit 7 of the N-th stage under control of a clock signal CLK.

In the first period, i.e., a pixel-retaining period, the method includes keeping voltage levels of the pull-up node PU and the output terminal OUTPUT at a low voltage level (0V) to reduce noise thereof under control of a voltage level of a pull-down node PD.

In the second period, i.e., a pre-pull-down period, the method includes pulling down voltage levels of a pre-pull-down node PDCN and the pull-down node PD to a turn-off voltage level before the pull-up node PU is charged to the turn-on voltage level under control of an input signal from an input terminal INPUT of the gate-driving unit circuit in the (N−1)-th stage.

In the third period, i.e., a pull-down period, the method including pulling down voltage levels of the pre-pull-down node PDCN and the pull-down node PD under control of the voltage level of the pull-up node PU.

In the sixth period, i.e., a reset period, the method includes outputting an output signal from an gate-driving unit circuit in an (N+2)-th stage and pulling down voltage levels of the pull-up node PU and the output terminal OUTPUT of the N-th stage based on the output signal from the (N+2)-th stage.

In an embodiment, the method includes, in the pre-pull-down period, pulling down the voltage levels of the pull-down node PD and the pre-pull-down node PDCN in at least a previous (N−1)-th cycle before charging the pull-up node PU. In particular, the method includes using an pre-pull-down sub-circuit 3 to pull down voltage levels of PD and PDCN ahead of time to avoid transistors in an noise-reduction sub-circuit 5 and other sub-circuits to be turned on at a same time.

In an embodiment, referring to FIG. 3, FIG. 4, and FIG. 5, the first transistor M1 is turned on in the input period and is charging the pull-up node PU under control of a gate-driving signal outputted from the gate-driving unit circuit in an (N−2)-th stage, two stages before the current N-th stage.

In the output period, under control of a clock signal CLK, the third transistor M3 is turned on to have the output sub-circuit to output a gate-driving signal of the current N-th stage.

In the pixel-retaining period, high voltage level provided to the power-supply terminal VDD controls the fifth transistor M5 and the sixth transistor M6 to be turned on and respectively controls voltage levels of the pre-pull-down node PDCN and pull-down node PD. Subsequently, the voltage level (correspondingly a noise level) at the pull-up node PU is reduced through the ninth transistor M9 and the voltage level at the output terminal OUTPUT is reduced through the tenth transistor M10.

In the pre-pull-down period, a gate-driving unit circuit in previous stage, i.e., (N−1)-th stage, provides an input signal INPUT effectively to a pre-pull-down signal terminal R_PD of the current stage to turn the eleventh transistor M11 on and pull down a voltage level of the pre-pull-down node PDCN to a low voltage level set by a reference voltage terminal VSS. Also, this R_PD signal turns the twelfth transistor M12 on to pull down a voltage level of the pull-down node PD to the low voltage level set by VSS. At a same time, the ninth transistor M9 and the tenth transistor M10 are turned off. Referring to time sector b shown in FIG. 5, using the transistors M11 and M12 in the pre-pull-down sub-circuit 3 to pull down voltage levels of PD and PDCN is able to turn transistors M9 and M10 off ahead of time.

In the pull-down period, the seventh transistor M7 and the eighth transistor M8 are turned on under control of a voltage of the pull-up node PU. Thus, the voltage levels of the pre-pull-down node PDCN and the pull-down node PD are pulled down to a turn-off (low) voltage level set by the reference voltage terminal VSS. This period is also a period for charging the pull-up node PU. The gate electrode and source electrode of the first transistor M1 are at high voltage level so that the turned-on M1 is able to charge the pull-up node PU. In this period, the third transistor M3 is turned on and the CLK signal is provided with a low voltage level, the output terminal outputs a voltage signal at VGH. Under a bootstrapping effect of the storage capacitor C and an effective capacitor Cgs between the gate electrode and source electrode of the third transistor M3, the voltage level of the pull-up node PU is pushed to 2 VGH. This can eliminate an effect of transistor threshold voltage Vth shift on the output signal.

In the reset period, a reset signal RESET (from an output signal of a gate-driving unit circuit in an (N+2)-th stage) is effectively at a high voltage level which turns the second transistor M2 and the fourth transistor M4 on. The voltage levels of the pull-up node PU and the output terminal OUTPUT are pulled down to a turn-off (low) voltage level.

In the pixel-retaining period, the pre-pull-down node PDCN and the pull-down node PD are at high voltage levels so that M9 and M10 are turned on. This keeps the pull-up node PU and the output terminal OUTPUT of the current stage GOA unit circuit at low voltage level (0V) to reduce noise. During a period of charging, bootstrapping, and resetting the pull-up node PU, the pull-up node PU is kept at high voltage level. M7 and M8 are turned on. Voltage levels at PDCN and PD are pulled down to low voltage level. M9 and M10 are turned off. The gate-driving unit circuit can output gate-driving signal normally.

Referring to FIG. 5 again, pulling down voltage levels of the pull-down node PD and the pre-pull-down node PDCN is achieved through transistors M7 and M8 when the voltage level of the pull-up node PU is a high voltage level. During pre-charging period to charge the pull-up node PU by input signal INPUT, pull-up node PU is pulled up to a high voltage level then the PD and PDCN are pulled down to a low voltage level at the same time.

Figure 6:
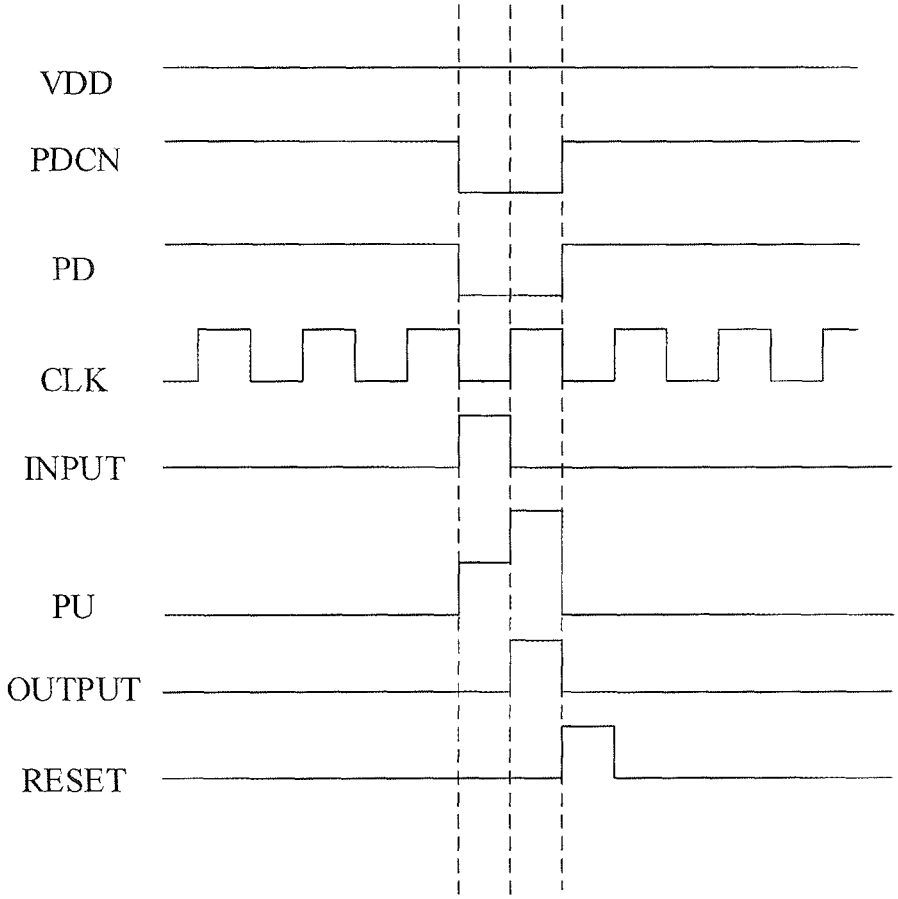
FIG. 6 is a timing diagram of driving a conventional gate driver on array circuit.

When operating a GOA circuit under a conventional design, as shown in FIG. 6, a rising edge of voltage level of the pull-up node PU is set to occur at a same time with a falling edge of voltage level of the pull-down node PD. Over the product working time, the transistor threshold voltages in the different gate-driving unit circuits of the GOA circuit may suffer different shifts to potentially cause signal delays among different stages. For example, referring to FIG. 1, the input signal INPUT and voltage signal at PD are delayed. In period a, the input signal INPUT is a high voltage, M1 is turned on to allow INPUT to charge PU. At the same time, voltage signal of PD is a high voltage, M9 is turned on to reduce noise of PU. There is a risk that the input signal, which is also the output signal from (n−2)-th stage, is pulled down. If the INPUT signal has a certain delay in period a as shown in FIG. 1 so as to remain at high voltage level to allow M1 to charge PU at the high voltage level. Theoretically, it requires that M7 and M8 being turned on to pull down voltage levels of PD and PDCN in time. While in real product, pulling down the voltage levels of PD and PDCN needs a finite time period, especially when the threshold voltages Vth of M7 and M8 have different drifts to extend the finite time period. Therefore, there is a risk that the INPUT signal, PD voltage, and PDCN voltage are all at high voltage in a same time period. This allows M1 and M9 be turned on at the same time to pull down the INPUT signal (i.e., the output signal from the (n−2)-th stage) to a low voltage level. Additionally, the margin of error in threshold voltage Vth drift for transistors M7 and M8 is very small, strongly affecting reliability of the GOA circuit. The gate-driving unit circuit of the present disclosure, as shown in FIG. 3, adds transistors M11 and M12 to pull down voltage levels of PD and PDCN ahead of time to avoid M1 and M9 being turned on at a same time. M11 and M12 are thin film transistors having very small size to be negligible in affecting boarder size of the display panel.

In still another aspect, the present disclosure provides a display apparatus including the gate driver on array (GOA) circuit containing cascaded multi-stage gate-driving unit circuits described herein. The GOA circuit is driven by the method described herein. The display apparatus can be one selected from a desktop computer, a tablet computer, a notebook computer, a smart phone, a PDA, a GPS, a car display, a projector, a camcorder, a digital camera, a digital watch, a calculator, an electronic equipment display, a liquid-crystal display panel, an electronic paper, a television, a displayer, a digital picture frame, and a navigator and any product or component having display function. This display apparatus can be applied in many fields including public display and virtual reality display.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A gate-driving unit circuit comprising:

an input sub-circuit coupled to an input terminal and a pull-up node, and configured to charge a pull-up node to a turn-on voltage level;

a pre-pull-down sub-circuit coupled to a pull-down node, a pre-pull-down node, and a reference voltage terminal, and configured to pull down voltage levels at the pull-down node and the pre-pull-down node to a turn-off voltage level before the pull-up node is charged to the turn-on voltage level;

a pull-down sub-circuit coupled to the input sub-circuit via the pull-up node, coupled to the pre-pull-down sub-circuit via the pre-pull-down node, coupled to the pull-down node and the reference voltage terminal, and configured to pull down a voltage level at the pull-down node to a turn-off voltage level;

a pull-down control sub-circuit coupled to the pre-pull-down sub-circuit via the pre-pull-down node and the pull-down sub-circuit via the pre-pull-down node or the pull-down node, and configured to pull down a voltage level at the pre-pull-down node and the pull-down node to the turn-off voltage level;

a noise-reduction sub-circuit coupled to the pull-down control sub-circuit and the pull-down sub-circuit via the pull-down node, coupled to the pull-up node, an output terminal, and the reference voltage terminal, and configured to stabilize voltage levels of the pull-up node and the output terminal; and an output sub-circuit coupled to the pull-up node, a clock signal terminal, the output terminal, and configured to output a gate-driving signal to the output terminal.

2. The gate-driving unit circuit of claim 1, wherein the input sub-circuit comprises a first transistor having a gate electrode and a first electrode coupled to the input terminal and a second electrode coupled to the pull-up node.

3. The gate-driving unit circuit of claim 1, wherein the pull-down control sub-circuit comprises a fifth transistor and a sixth transistor, the fifth transistor having a gate electrode and a first electrode coupled to a power-supply voltage terminal, and a second electrode coupled to the pre-pull-down node; the sixth transistor having a gate electrode coupled to the pre-pull-down node, a first electrode coupled to the first electrode of the fifth transistor, and a second electrode coupled to the pull-down node.

4. The gate-driving unit circuit of claim 1, wherein the pre-pull-down sub-circuit comprises an eleventh transistor and a twelfth transistor, the eleventh transistor having a gate electrode coupled to a pre-pull-down signal terminal, a first electrode coupled to the reference voltage terminal, and a second electrode coupled to the pre-pull-down node; the twelfth transistor having a gate electrode coupled to the pre-pull-down signal terminal, a first electrode coupled to the reference voltage terminal, and a second electrode coupled to the pull-down node.

5. The gate-driving unit circuit of claim 1, wherein the pull-down sub-circuit comprises a seventh transistor and an eighth transistor, the seventh transistor having a gate electrode coupled to the pull-up node, a first electrode coupled to the reference voltage terminal, and a second electrode coupled to the pre-pull-down node, the eighth transistor having a gate electrode coupled to the pull-up node, a first electrode coupled to the reference voltage terminal, and a second electrode coupled to the pull-down node.

6. The gate-driving unit circuit of claim 1, further comprising a reset sub-circuit coupled to the pull-up node, the output terminal, a reset signal terminal, and the reference voltage terminal, and configured to reset voltage levels of the pull-up node and the output terminal; wherein the reset sub-circuit comprises a second transistor and a fourth transistor, the second transistor having a gate electrode coupled to a reset signal terminal, a first electrode coupled to the reference voltage terminal, and a second electrode coupled to the pull-up node, the fourth transistor having a gate electrode coupled to the reset signal terminal, a first electrode coupled to the reference voltage terminal, and a second electrode coupled to the output terminal.

7. The gate-driving unit circuit of claim 1, wherein the noise-reduction sub-circuit comprises a ninth transistor and a tenth transistor, the ninth transistor having a gate electrode coupled to the pull-down node, a first electrode coupled to the reference voltage terminal, and a second electrode coupled to the pull-up node, the tenth transistor having a gate electrode coupled to the pull-down node, a first electrode coupled to the reference voltage terminal, and a second electrode coupled to the output terminal.

8. The gate-driving unit circuit of claim 1, wherein the output sub-circuit comprises a third transistor and a storage capacitor, the third transistor having a gate electrode coupled to the pull-up node, a first electrode coupled to a clock signal terminal, and a second electrode coupled to the output terminal, and the storage capacitor having a first port coupled to the pull-up node and a second port coupled to the output terminal.

9. The gate-driving unit circuit of claim 1, wherein the turn-on voltage level comprises a voltage level applicable to a gate electrode of a transistor that allows a first electrode of the transistor to be connected with a second electrode of the transistor, and the turn-off voltage level comprises a voltage level applicable to a gate electrode of a transistor that allows a first electrode of the transistor to be disconnected from a second electrode of the transistor.

10. A gate driver on array (GOA) circuit, comprising a plurality of gate-driving unit circuits cascaded in a multi-stage series, each of the plurality of gate-driving unit circuits being configured according to claim 1, wherein the multi-stage series comprises at least a gate-driving unit circuit in an (N−2)-th stage coupled to a gate-driving unit circuit in an (N−1)-th stage which further is coupled to a gate-driving unit circuit in an N-th stage, wherein N is an integer greater than 2.

11. The GOA circuit of claim 10, wherein the gate-driving unit circuit in each of the multi-stage series comprises:

a first transistor having a gate electrode and a first electrode commonly coupled to an input terminal and a second electrode coupled to a pull-up node;

a second transistor having a gate electrode coupled to a reset signal terminal, a first electrode coupled to a reference voltage terminal, and a second electrode coupled to the pull-up node;

a third transistor having a gate electrode coupled to the pull-up node, a first electrode coupled to a clock signal terminal, and a second electrode coupled to an output terminal;

a fourth transistor having a gate electrode coupled to the reset signal terminal, a first electrode coupled to the reference voltage terminal, and a second electrode coupled to the output terminal;

a fifth transistor having a gate electrode and a first electrode coupled to a power-supply voltage terminal, and a second electrode coupled to a pre-pull-down node;

a sixth transistor having a gate electrode coupled to the pre-pull-down node, a first electrode coupled to the first electrode of the fifth transistor, and a second electrode coupled to a pull-down node;

a seventh transistor having a gate electrode coupled to the pull-up node, a first electrode coupled to the reference voltage terminal, and a second electrode coupled to the pre-pull-down node;

an eighth transistor having a gate electrode coupled to the pull-up node, a first electrode coupled to the reference voltage terminal, and a second electrode coupled to the pull-down node;

a ninth transistor having a gate electrode coupled to the pull-down node, a first electrode coupled to the reference voltage terminal, and a second electrode coupled to the pull-up node;

a tenth transistor having a gate electrode coupled to the pull-down node, a first electrode coupled to the reference voltage terminal, and a second electrode coupled to the output terminal;

an eleventh transistor having a gate electrode coupled to the pre-pull-down signal terminal, a first electrode coupled to the reference voltage terminal, and a second electrode coupled to the pre-pull-down node;

a twelfth transistor having a gate electrode coupled to the pre-pull-down signal terminal, a first electrode coupled to the reference voltage terminal, and a second electrode coupled to the pull-down node; and a storage capacitor having a first port coupled to the pull-up node and a second port coupled to the output terminal.

12. The GOA circuit of claim 11, wherein the gate-driving unit circuit in the (N−2)-th stage comprises an output terminal connected to the input terminal of the gate-driving unit circuit in an N-th stage; the gate-driving unit circuit in the (N−1)-th stage comprises an input terminal connected to a pre-pull-down signal terminal of the gate-driving unit circuit in the N-th stage; and the gate-driving unit circuit in an (N+2)-th stage comprises an output terminal connected to the reset signal terminal of the gate-driving unit circuit in the N-th stage.

13. A method of driving a GOA circuit of claim 10, comprising driving a gate-driving unit circuit in an N-th stage in an N-th cycle of displaying one frame of image progressively from one stage after another, wherein the N-th cycle comprises a duration commonly for every cycle including sequentially a first period, a second period, a third period, a fourth period, a fifth period, and a sixth period.

14. The method of claim 13, wherein the driving a gate-driving unit circuit in the N-th stage comprises:

in the first period of the N-th cycle, keeping a pull-up node and an output terminal of the gate-driving unit circuit in an N-th stage to a turn-off voltage level under control of a voltage level at a pull-down node in the gate-driving unit circuit in an N-th stage;

in the second period of the N-th cycle, pulling down a voltage level at a pre-pull-down node and a voltage level at the pull-down node of the gate-driving unit circuit in the N-th stage to a turn-off voltage level under control of an input signal of the gate-driving unit circuit in the (N−1)-th stage before charging the pull-up node;

in the third period of the N-th cycle, keeping the voltage level of the pre-pull-down node and the voltage level of the pull-down node to the turn-off voltage level under control of the turn-on voltage level charged to the pull-up node;

in the fourth period of the N-th cycle, receiving an output signal from the gate-driving unit circuit in the (N−2)-th stage into an input terminal of the gate-driving unit circuit in the N-th stage, and storing the output signal at an pull-up node of the gate-driving unit circuit in the N-th stage for charging the pull-up node;

in the fifth period of the N-th cycle, outputting a gate-driving signal to a gate line of the N-th stage under control of a clock signal; and in the sixth period of the N-th cycle, receiving an output signal from the gate-driving unit circuit in an (N+2)-th stage into a reset terminal of the gate-driving unit circuit in the N-th stage, and pulling down the voltage level at the pull-up node and the voltage level at the output terminal of the gate-driving unit circuit in the N-th stage.

15. The method of claim 14, wherein pulling down the voltage level at the pre-pull-down node and the voltage level at the pull-down node of the gate-driving unit circuit in the N-th stage to the turn-off voltage level is performed at least during an (N−1)-th cycle or earlier before the N-th cycle.

16. The method of claim 15, wherein pulling down the voltage level at the pre-pull-down node and the voltage level at the pull-down node comprises receiving an input signal of the turn-on voltage level by an input terminal of the gate-driving unit circuit in the (N−1)-th stage and passing the turn-on voltage level to a pre-pull-down signal terminal of the gate-driving unit circuit in the N-th stage to allow the pre-pull-down node and the pull-down node connected with a reference voltage terminal fixed at the turn-off voltage level.

17. The method of claim 14, wherein keeping a pull-up node and an output terminal of the gate-driving unit circuit in an N-th stage to a turn-off voltage level comprises applying a power-supply voltage at a turn-on voltage level at least in the first period to respectively make the pre-pull-down node and the pull-down node at the turn-on voltage level to allow the pull-up node and the output terminal connected the reference voltage terminal fixed at the turn-off voltage level.

18. A display apparatus, comprising the GOA circuit of claim 10.

19. A gate-driving unit circuit, comprising:

a first transistor having a gate electrode and a first electrode commonly coupled to an input terminal and a second electrode coupled to a pull-up node;

a second transistor having a gate electrode coupled to a reset signal terminal, a first electrode coupled to a reference voltage terminal, and a second electrode coupled to the pull-up node;

a third transistor having a gate electrode coupled to the pull-up node, a first electrode coupled to a clock signal terminal, and a second electrode coupled to an output terminal;

a fourth transistor having a gate electrode coupled to the reset signal terminal, a first electrode coupled to the reference voltage terminal, and a second electrode coupled to the output terminal;

a fifth transistor having a gate electrode and a first electrode coupled to a power-supply voltage terminal, and a second electrode coupled to a pre-pull-down node;

a sixth transistor having a gate electrode coupled to the pre-pull-down node, a first electrode coupled to the first electrode of the fifth transistor, and a second electrode coupled to a pull-down node;

a seventh transistor having a gate electrode coupled to the pull-up node, a first electrode coupled to the reference voltage terminal, and a second electrode coupled to the pre-pull-down node;

an eighth transistor having a gate electrode coupled to the pull-up node, a first electrode coupled to the reference voltage terminal, and a second electrode coupled to the pull-down node;

a ninth transistor having a gate electrode coupled to the pull-down node, a first electrode coupled to the reference voltage terminal, and a second electrode coupled to the pull-up node;

a tenth transistor having a gate electrode coupled to the pull-down node, a first electrode coupled to the reference voltage terminal, and a second electrode coupled to the output terminal;

an eleventh transistor having a gate electrode coupled to the pre-pull-down signal terminal, a first electrode coupled to the reference voltage terminal, and a second electrode coupled to the pre-pull-down node;

a twelfth transistor having a gate electrode coupled to the pre-pull-down signal terminal, a first electrode coupled to the reference voltage terminal, and a second electrode coupled to the pull-down node; and a storage capacitor having a first port coupled to the pull-up node and a second port coupled to the output terminal.

* * * * *